US009302304B2

(12) United States Patent
Yamamoto et al.

(10) Patent No.: US 9,302,304 B2
(45) Date of Patent: Apr. 5, 2016

(54) EXTRUSION PRESS AND CONTROL METHOD FOR EXTRUSION PRESS

(75) Inventors: Takeharu Yamamoto, Ube (JP); Atsushi Yakushigawa, Ube (JP); Koji Nakano, Ube (JP)

(73) Assignee: Ube Machinery Corporation, Ltd. (JP)

( * ) Notice: Subject to any disclaimer, the term of this patent is extended or adjusted under 35 U.S.C. 154(b) by 17 days.

(21) Appl. No.: 14/342,107

(22) PCT Filed: Aug. 1, 2012

(86) PCT No.: PCT/JP2012/069621

§ 371 (c)(1),
(2), (4) Date: Feb. 28, 2014

(87) PCT Pub. No.: WO2013/035462

PCT Pub. Date: Mar. 14, 2013

(65) Prior Publication Data

US 2014/0216122 A1 Aug. 7, 2014

(30) Foreign Application Priority Data

Sep. 5, 2011 (JP) ..... 2011-192212

(51) Int. Cl.
*B21C 31/00* (2006.01)
*B21C 23/21* (2006.01)
*B21C 27/00* (2006.01)

(52) U.S. Cl.
CPC ..... *B21C 31/00* (2013.01); *B21C 23/21* (2013.01); *B21C 23/215* (2013.01); *B21C 27/00* (2013.01)

(58) Field of Classification Search
CPC .... B21C 23/21; B21C 23/215; B21C 23/212; B21C 27/00; B21C 27/04; B21C 31/00; B21C 51/00; B30B 9/248
USPC ..... 72/21.3, 31.01, 31.13, 271, 272
See application file for complete search history.

(56) References Cited

U.S. PATENT DOCUMENTS 5,445,004 A * 8/1995 Nannini et al. ..... 72/272
5,613,393 A * 3/1997 Bessey ..... 72/272

(Continued)

FOREIGN PATENT DOCUMENTS

JP 03-146217 6/1991
JP 04-251610 9/1992

(Continued)

OTHER PUBLICATIONS

Corresponding Office Action of corresponding CN Application No. 201280042888.4 issued Jan. 6, 2015 along with English translation.

(Continued)

*Primary Examiner* — Peter DungBa Vo
*Assistant Examiner* — Joshua D Anderson

(57) ABSTRACT

An extrusion press includes a means which can prevent phenomena in which a billet is blown out during an extrusion process as well as prevent billet blowout with a simple and inexpensive constitution. The extrusion press drives a main cylinder device to extrude, by a stem, a billet filled into a container from a die and form a product. A gap measurement means that measures a gap arising at the container seal surface formed by pressing the die side end surface of the container against the container side end surface of the die is provided on an end platen on the outer edge part of the container side end surface of the die. When the gap arising during the extrusion process is measured and the measured value is within a predetermined range of allowable values, a set value for the extrusion rate is lowered and a warning is issued. When the measured value exceeds the predetermined allowable values, the extrusion process is stopped.

1 Claim, 3 Drawing Sheets

(56) References Cited

U.S. PATENT DOCUMENTS

| | | | | |
|---|---|---|---|---|
| 2007/0172533 | A1* | 7/2007 | Pinchot | 425/142 |
| 2007/0227221 | A1* | 10/2007 | Yamamoto | 72/271 |
| 2010/0000283 | A1* | 1/2010 | Yamamoto et al. | 72/272 |

FOREIGN PATENT DOCUMENTS

| | | |
|---|---|---|
| JP | 04-274821 | 9/1992 |
| JP | 2010-179332 | 8/2010 |

OTHER PUBLICATIONS

Second Office Action dated Sep. 14, 2015 of corresponding Chinese Application No. 201280042888.4 along with an English translation.

Notice of Reasons for Rejection dated Jun. 16, 2015 of corresponding Japanese Patent Application No. 2011-192212 along with an English translation.

* cited by examiner

EXTRUSION PRESS AND CONTROL METHOD FOR EXTRUSION PRESS

CROSS REFERENCE TO RELATED APPLICATION

The present invention claims priority from, and incorporates by reference the entire disclosure of, Japanese Patent Application No. 2011-192212, filed on Sep. 5, 2011.

TECHNICAL FIELD

The present invention relates to an extrusion press which is used for extrusion of aluminum alloy etc. and a control method for an extrusion press, more particularly relates to an extrusion press which prevents leak out of metal from a gap between a container and die in the extrusion process and thereby improve the product yield and to a control method for such an extrusion press.

BACKGROUND ART

In a conventional extrusion press, provision is made for an end platen and a main cylinder device which are coupled by tie rods. At the end platen side, a container in which a billet is loaded is arranged across a die, while at a main cylinder device side, a stem is attached to a cross head which is driven together with a ram which is inserted into and withdrawn from this cylinder. Further, the stem is pushed under pressure toward the billet which is loaded in the container by the extrusion force of the main cylinder device whereby a product of a predetermined shape is extruded from the die.

In such an extrusion press, in the extrusion process, the length of the billet inside the container gradually becomes shorter, so it is usual that the extrusion action force becomes larger at the time of start of the extrusion process than at the time of end of the extrusion process. That is, even if the extrusion resistance of the die (required extrusion force) is constant, the frictional force between the container and the billet becomes smaller along with the decrease in the length of the billet, so overall the extrusion action force gradually ends up falling.

The change in the extrusion action force is due to the decrease in the frictional force between the billet and the inside walls of the container along with the billet length, but such a decrease in the extrusion action force causes a decrease in the container seal force with respect to the die. When the force falls below the seal force which prevents breakout of the billet, the billet ends up breaking out from the seal surface of the container and die in a so-called "blooming phenomenon". This blooming phenomenon causes the product yield to drop and lowers the operating efficiency of the extrusion press due to the work of removing the residue from the seal surface.

For this reason, when the extrusion action force falls and becomes less than the seal force which prevents break out of the billet, a means which compensates for the drop in the extrusion action force which imparts the container seal force between the container and the die may be provided at the cross head so as to avoid break out of the billet. (See PLT 1.)

In this regard, since, in the above conventional type of extrusion press, to prevent break out of the billet, a means for compensating for the drop in extrusion action force is provided at the cross head, this led to enlargement of the facility and complication of the control and further resulted in a rise in the cost of manufacture of the facility.

CITATION LIST

Patent Literature

PLT 1: Japanese Patent Publication No. 4-274821A

SUMMARY OF INVENTION

Technical Problem

The present invention is made in order to solve the above problem and has as its object the provision of an extrusion press which can prevent the phenomenon of the billet breaking out during the extrusion process and which is provided with a simple and inexpensive configuration of a means for preventing break out of the billet and a control method for such an extrusion press.

Solution to Problem

To achieve the above object, according to a first aspect of the present invention, there is provided an extrusion press which drives a main cylinder device to extrude a billet which is loaded in a container from a die by a stem so as to form a product, the extrusion press characterized in that a gap measuring means for measuring a gap in an extrusion process which is formed at a container seal surface which is formed by pushing a die side end face of the container against a container side end face of the die is provided at an end platen of the outer edge of the container side end face of the die through an attachment member.

To achieve the above object, according to a second aspect of the present invention, there is provided a control method for an extrusion press which drives a main cylinder device to extrude a billet which is loaded in a container from a die by a stem to form a product, the control method is characterized by measuring a gap which is formed during an extrusion process at a container seal surface which is formed by pushing a die side end face of the container against a container side end face of the die, when the measured value is in a predetermined range of an allowable value, lowering a setting of an extrusion speed and emitting an alarm, and, when the measured value is over a predetermined allowable value, making the extrusion process stop.

Advantageous Effects of Invention

Since the invention is configured to measure a gap between a container end face and a die end face during the extrusion process, it is possible to detect this as compression strain of the die and possible to obtain a grasp of the behavior of the container in a state where the container seal surface is in action as a forewarning of a break out phenomenon of the billet. Further, a configuration which provides a means for measuring a gap between a container and a die at an end platen of an outer edge part of the container seal surface side of the die never invites increased size of the facility or higher cost.

Since the invention is configured to measure a gap between a container end face and a die end face to compare it with an allowable value, lower the extrusion speed and emit an alarm when it is in a range of the allowable value, and stop the extrusion process when exceeds the allowable value, the break out phenomenon of the billet never occurs.

For this reason, fall of the product yield due to loss of the material which accompanies break out or fall of the operating rate due to the facility stopping along with disposal of the broken out residue never occurs.

The present invention will become more clearly understood from the attached drawings and the explanation of preferred embodiments of the present invention.

DESCRIPTION OF EMBODIMENTS

The extrusion press device and control method for an extrusion press according to the present invention will be explained in detail with reference to the drawings.

Figure 1:
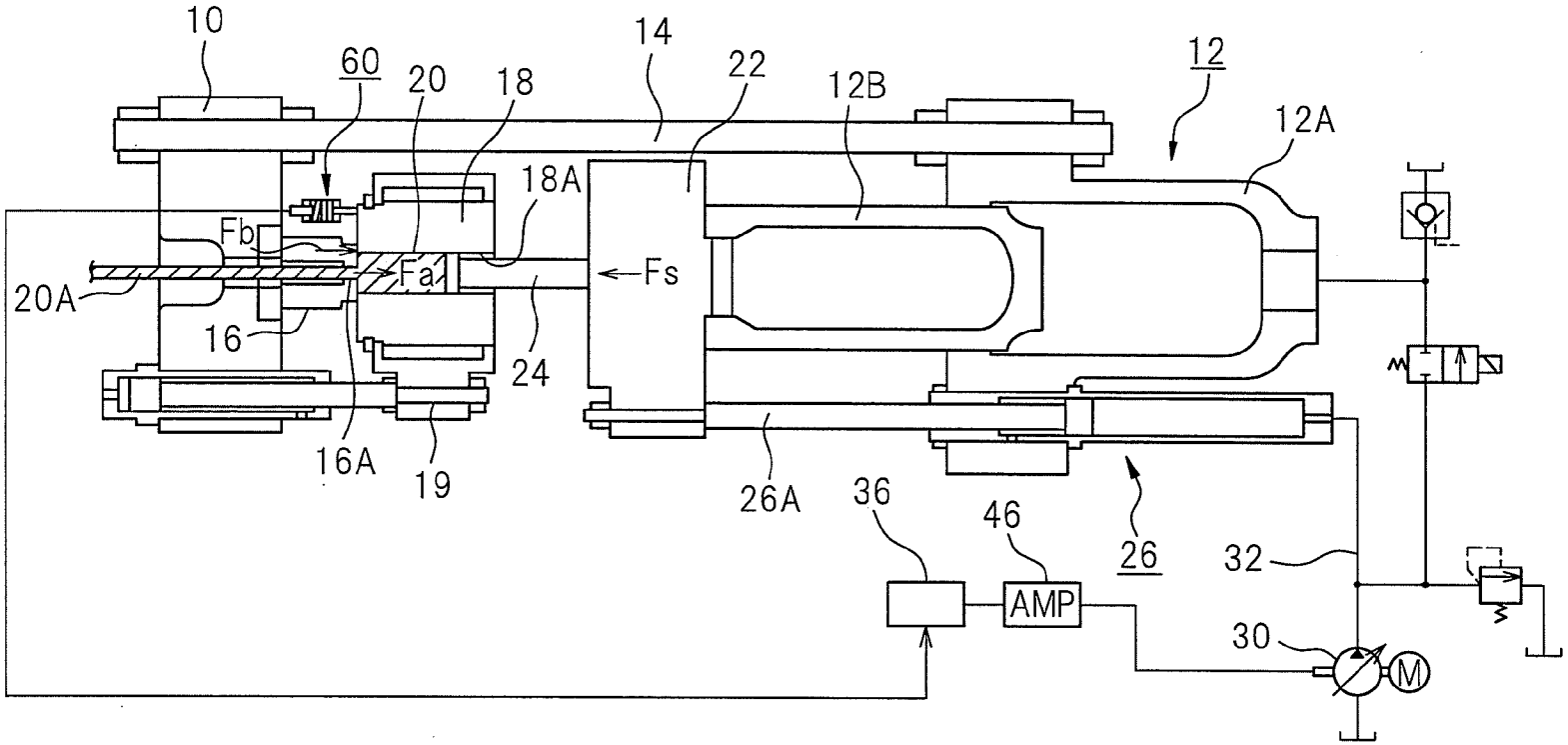
FIG. 1 is a cross-sectional view which shows the overall configuration of an extrusion press according to an embodiment of the present invention.

As shown in FIG. 1, the extrusion press has an end platen 10 and a main cylinder device 12 arranged facing each other. The two are coupled by a plurality of tie rods 14. At the inner surface side of the end platen 10, a container 18 is arranged across a die 16 in which an extrusion opening is formed. The container 18 is loaded with a billet 20. By pushing this toward the die 16, a product of a cross-section corresponding to the die opening 16A is extruded.

The main cylinder device 12 which generates an extrusion force is comprised of a main cylinder 12A in which a main ram 12B is housed. This can be moved toward the container 18 for extrusion. At a front end part of this main ram 12B, a main cross head 22 is attached. At the center of this front surface, an extrusion stem 24 is attached in a state sticking out toward the container 18 so as to be arranged coaxially with a billet loading opening 18A of the container 18.

Therefore, if driving the main cylinder device 12 to make the cross head 22 advance, the extrusion stem 24 is inserted in the loading opening 18A of the container 18 and the back end face of the loaded billet 20 is pressed to extrude a product 20A.

Note that, at the main cylinder 12A, a side cylinder device 26 is attached in parallel to an axial center of the extrusion press. A rod 26A is coupled with the main cross head 22. Due to this, as a preparatory process of the extrusion process, an extrusion stern 24 is made to initially move to a position which approaches a container 18 band an extrusion pressure operation is configured to be performed by both the main cylinder device 12 and side cylinder device 26.

Further, the extrusion press is provided with a variable discharge type of hydraulic pump 30. Through a hydraulic circuit 32, discharge oil pressure is supplied to the main cylinder device 12 and side cylinder device 26.

In this regard, during the extrusion process, the main cylinder device 12 and the side cylinder device 26 are used to perform an extrusion action, and the extrusion action force Fs is expressed by the sum of the required extrusion force Fa which acts on the die 16 and the billet frictional force Fb between the billet 20 and the container 18. The billet frictional force Fb changes in proportion to the length of the billet 18 and is maximum at the time of extrusion start. As the extrusion process proceeds and the billet length becomes shorter, it decreases along with the extrusion action force Fs.

The billet frictional force Fb acts as the seal force of the die 16 and the container 18, so if the billet frictional force Fb decreases too much, the seal force which prevents the billet 18 from leaking out (so-called "blooming phenomenon") from the seal surface of the die 16 and the container 18 ends up falling.

Figure 2:
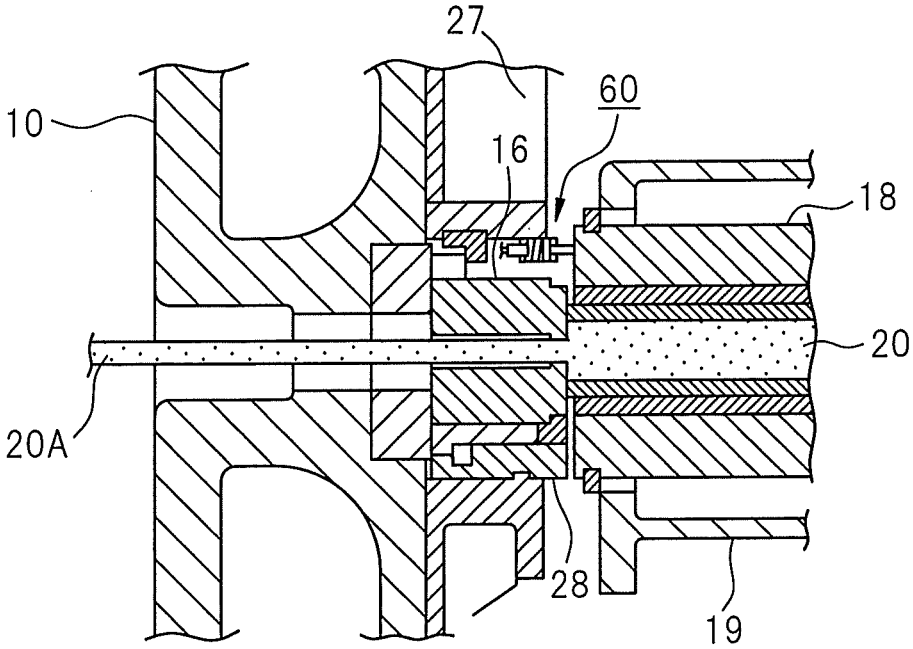
FIG. 2 is a cross-sectional view which shows the configuration of a gap measuring means according to an embodiment of the present invention.
Figure 3:
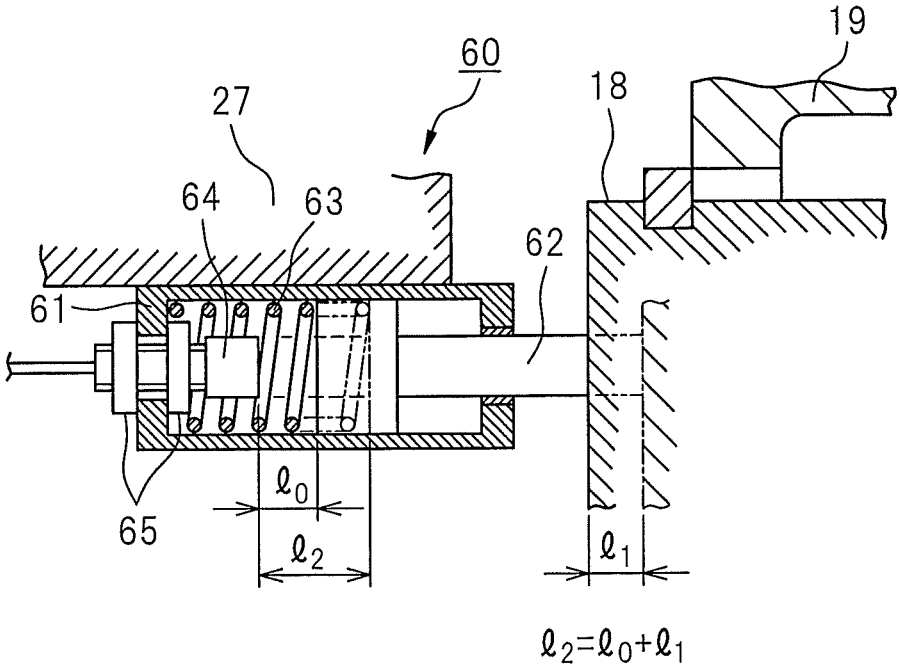
FIG. 3 is a cross-sectional view which shows principal parts of the gap measuring means which is shown in FIG. 2.

In the extrusion press according to the present embodiment, as shown in FIG. 2 and FIG. 3, a gap measuring means 60 for measuring the gap which is formed in the extrusion process at the seal surface which is formed by the die side end face of the container 18 and the container side end face of the die 16 abutting against each other is attached to the end platen of an outer edge part of the die 16 of the container side end face through an attachment member.

This gap measuring means 60 is basically comprised of a guide box 61 which is attached to a container side bottom surface of an upper gib 27 which is fastened to the end platen 10 so that its axial line becomes parallel to the extrusion direction, a gap measurement rod 62 which has a tip which abuts against a die side end face of the container 18, which has another end which is provided to be able to slide inside the guide box 61, and which has a stepped shaft shape, a coil spring 63 which is arranged inside the guide box 61 and which pushes the gap measurement rod 62 in the axial direction, and a displacement sensor 64 and fastening nut 65 for the displacement sensor.

The displacement sensor 64 which is used for the gap measuring means 60 is preferably an eddy current type or optical type or ultrasonic type or other noncontact type. In this embodiment, the gap measuring means 60 which is comprised by a single displacement sensor 64 is provided above the die 16 avoiding the shear blade which shears off the discharge, but it is also possible to provide a plurality of gap measuring means 60 and output their measured values as an average value. When providing a plurality of gap measuring means 60, for example, one of the gap measuring means 60 is provided below the die 16, a through hole is formed at the container seal surface side of the lower gib 28 which is shown in FIG. 2, and the means is attached buried in this.

As shown in FIG. 3, if the container 18 moves in the counter extrusion direction (right direction in figure) from the state where the end faces of the die 16 and container 18 abut, the gap measurement rod 62 is pushed by the coil spring 63 and moves in the counter extrusion direction linked with movement of the container.

$l_0$ is the gap between the displacement sensor 64 and the gap measurement rod 62. It is the reference value of the measured gap which has as the minimum value the value after upset is completed and the die side end face of the container 18 and container side end face of the die 16 abut to form a container seal surface and which changes to expand in accordance with the decrease of the billet frictional force Fb which accompanies progress in the extrusion process.

$l_1$ is the allowable value of the gap with the die 16 which is formed when the seal force which prevents the billet 18 from leaking out from the seal surface between the die 16 and the container 18 during the extrusion process (so-called "blooming phenomenon") falls and the container 18 retracts in the counter extrusion direction (separates from the die 16).

$l_2$ is the gap between the displacement sensor 64 and the gap measurement rod 62 when the container 18 retracts during the extrusion process and is the upper limit value of the measured gap comprised of the reference value of the measured gap $l_0$ and the allowable value $l_1$ added together at the time of start of extrusion by the die 16 and the container 18.

Further, the gap measuring means 60 is used to measure the value of the reference value of the measured gap $l_0$ during the extrusion process and output it to the extrusion press device. When the measured value is in the range of the allowable value, the extrusion speed is controlled to a low speed to slow the flow of the material in the container and prevent leak out of the billet.

Next, the control method for the extrusion press which is configured in this way will be explained. The reference value of the measured gap $l_0$ is found by making the container 18 move forward to abut against the die 16, making the extrusion stem 24 push against the billet 20, detecting the gap at the advanced position of the container when the upset is completed, and storing this rewritten for each extrusion operation in the controller 36 of the extrusion press. Further, when replacing the die 16 or the container 18, the reference value of measured gap $l_0$ is detected each time and is rewritten as new data.

The allowable value $l_1$ is set in the controller 36 in advance as a predetermined value. For example, the range of this value is set to an optimum value from 0.1 to 1.0 mm or multiplied by a ratio of 0.7 to 0.8 in range.

In the control method for an extrusion press of the present invention, when the gap between the container 18 and the die 16 is in the set range of the allowable value $l_1$, the gap is kept from becoming larger by having the controller 36 perform control so as to output a signal through an amplifier 46 to the hydraulic pump 30 to lower the extrusion speed and emit an alarm. Further, when, even if controlling the extrusion speed, the gap between the container 18 and the die 16 exceeds the set range of the allowable value $l_1$, the extrusion process is made to stop.

The gap measuring means 60 measures the gap between the container 18 and the die 16 in the extrusion process, calculates the rate of change, and controls the discharge of the hydraulic pump 30 in accordance with the calculated rate of change of the measured gap.

Further, in the control of the hydraulic pump, the gap between the die 16 and the container 18 may be set as a parameter and a means for controlling the extrusion speed to become slower in steps based on this parameter or means for increasing the extrusion speed in steps if the gap between the die 16 and the container 18 is reduced may be used.

In this way, in the control method for the present invention, it is possible to accurately measure the position of the container with respect to the container side end face of the die 16 so as to obtain a grasp of a forewarning of break out of the billet from the gap between the container 18 and the die 16 and lower the extrusion speed so as to prevent break out of the billet.

Figure 4:
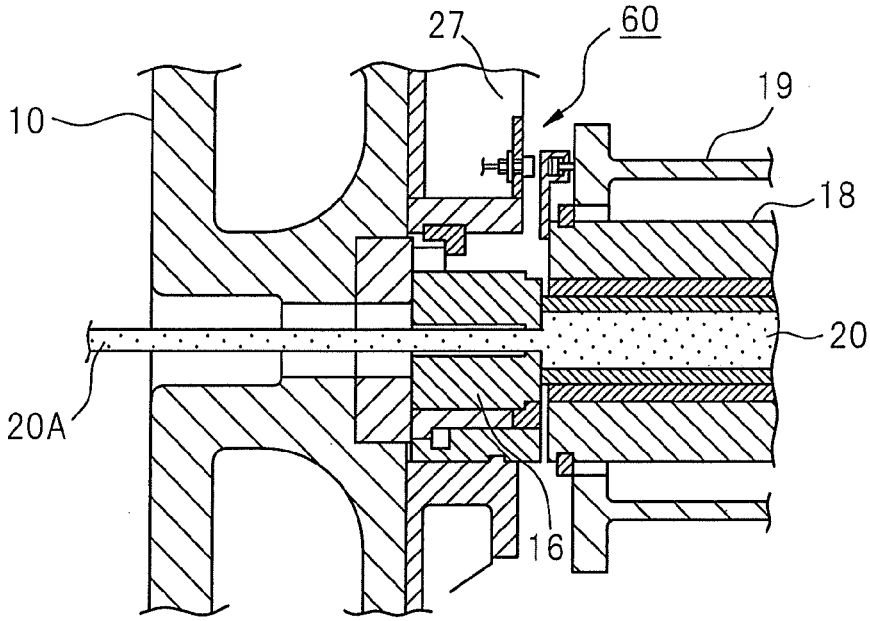
FIG. 4 is a cross-sectional view which shows the configuration of a gap measuring means according to another embodiment.
Figure 5:
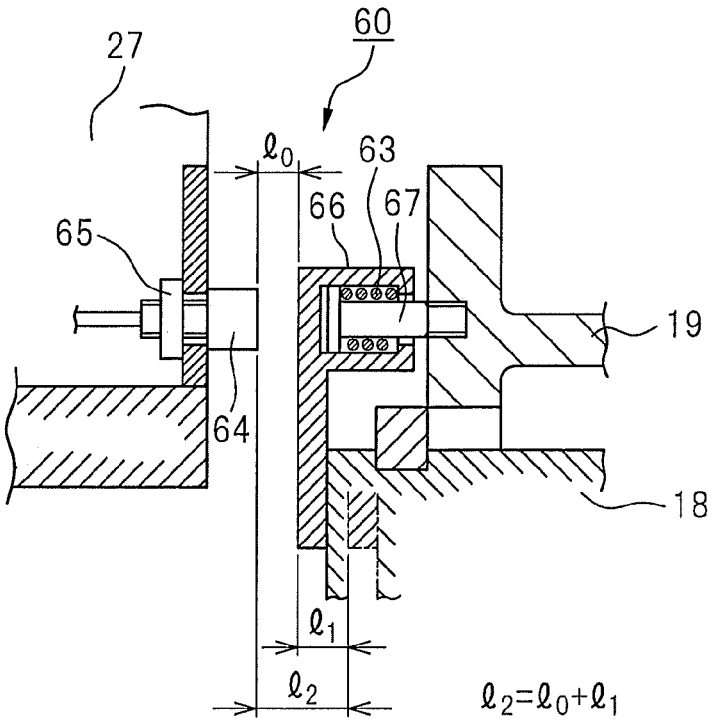
FIG. 5 is a cross-sectional view which shows principal parts of the gap measuring means which is shown in FIG. 4.

FIG. 4 and FIG. 5 will be used to explain a gap measuring means according to another embodiment. As shown in FIG. 4 and FIG. 5, a gap measuring means 60 for measuring the gap which is formed in the extrusion process at a seal surface which is formed by a die side end face of the container 18 and a container side face of the die 16 is provided at the outer edge part seal surface side of the die 16.

This gap measuring means 60 is basically configured by a displacement sensor 64 which is attached to the container side end face of an upper gib 27 which is fastened to the end platen 10 so that its axial line becomes parallel with the extrusion direction and a fastening nut 65 for the displacement sensor, a fixed shaft 67 which is screwed into a die side end face of the container holder 19, is attached so that its axial line becomes parallel with the extrusion direction, and is made a stepped shaft shape, a gap measurement plate 66 which has a bottom end which abuts against a seal surface side end face of the container 18 and which has another end which is provided able to be guided by the fixed shaft 67, and a coil spring 63 which is arranged inside of the gap measurement plate 66, is clamped by another end of the fixed shaft 67, and moves pushing in the axial direction.

The displacement sensor 64 which is used for the gap measuring means 60 is preferably an eddy current type or optical type or ultrasonic type or other noncontact type. In this embodiment, a gap measuring means 60 which is configured by a single displacement sensor 64 is provided away from the shear blade which shears off the discard above the die 16, but it is also possible to provide a plurality of gap measuring means 60 and output their detection values as an average value.

The relationship among the reference value of measured gap $l_0$, allowable value $l_1$, and upper limit value of measured gap $l_2$ and the control method for an extrusion press in accordance with the data of the measured gap are based on the explanation of the above FIG. 2 and FIG. 3.

In the gap measuring means 60 of the present invention, rather than directly attaching the gap measurement rod 62 and the gap measurement plate 66 to the container 18, the gap from the displacement sensor 64 is measured. Being configured in this way, when replacing the container 18, it is possible to do so without detaching the gap measurement rod 62 and the gap measurement plate 66, so it is possible to perform the work of replacing the container 18 efficiently.

The gap measurement rod 62 and the gap measurement plate 66 are pushed at one end by the coil spring 63 against the die 16 side end face of the container 18, so even if the container 18 moves to the counter extrusion direction to separate from the die 16, that gap can be reliably measured.

The reference value of measured gap $l_0$ is found in advance by for example using Siebel's formula to calculate the required extrusion force Fa which acts on the die 16, which fluctuates during the extrusion process for each product, and the billet frictional force Fb between the billet 20 and the container 18 and storing them in the controller 36. Further, it is possible to use the data which is set during extrusion as the basis to find $l_0$ and $l_2$ in real time and compare them with actually measured data to thereby prevent break out of the billet in a control routine.

Further, the gap measuring means 60 may be configured to detect a reference value of the measured gap $l_0$ (minimum value) for each extrusion process, compare it with the measured gap at the immediately preceding extrusion process (minimum value), and judge that there is an inclusion at the abutting surfaces of the container 18 and the die 16, for example, discard, when the compared value is larger than a predetermined value. With this configuration, residue at the abutting faces of the container 18 and the die 16 can be detected before the start of extrusion and break out of the billet due to residue can be prevented during the extrusion process, so it is possible to improve the operating rate of the extrusion press.

As explained above, in the extrusion press device and control method for extrusion press device of the present invention, it is possible to prevent break out by a simple, inexpensive means without compensating for the extrusion force to prevent break out of the billet and thereby increasing the container seal force.

Further, it is possible to eliminate interruptions in the extrusion process due to breakout of the billet and to improve the product yield and operating rate.

The present invention is explained by reference to specific embodiments selected for the purpose of explanation, but it will be clear to a person skilled in the art that a large number of modifications are possible without departing from the basic idea and scope of the present invention.

Reference Signs List

10 end platen
12 main cylinder device
16 die
18 container
20 billet
20A product
24 stem
60 gap measuring means
61 guide box
62 gap measurement rod
63 coil spring
64 displacement sensor
65 fastening nut
66 gap measuring plate
67 fixed shaft
$l_0$ reference value of measured gap
$l_1$ allowable value
$l_2$ upper limit value of measured gap

The invention claimed is:

1. A method of controlling an extrusion press, the method comprising the steps of:

driving a main cylinder device to extrude a billet, loaded in a container sized and shaped to receive a stem of a ram, from a die by the stem to form a product;

measuring a gap between a die side end face of said container and a container side end face of said die formed during an extrusion process of the billet;

when a measured value of the gap is in a predetermined allowable range, lowering a setting of an extrusion speed to reduce the enlargement of the gap and emitting an alarm; and when said measured value is over the allowable range, making said extrusion process stop, wherein, in the step of measuring the gap, the gap is measured by a gap measuring means comprising a displacement sensor provided at an outer edge of a container side end face of an end platen provided adjacent to the container side end face of said die and a gap measurement rod that is linked with the movement of said container away from said die to form the gap, wherein the gap measurement means measures a distance between the displacement sensor and the gap measurement rod to determine the gap between the die side end face of said container and the container side end face of said die.

* * * * *